US005895879A

United States Patent [19]

Kamiya et al.

[11] Patent Number: 5,895,879

[45] Date of Patent: *Apr. 20, 1999

[54] MUSICAL TONE-GENERATING METHOD AND APPARATUS CAPABLE OF APPROXIMATING ENVELOPE CHARACTERISTIC OF A WAVEFORM OF A MUSICAL TONE BY A POLYGONAL LINE

[75] Inventors: Ryo Kamiya; Masahiro Mukojima, both of Hamamatsu, Japan

[73] Assignee: Yamaha Corporation, Hamamatsu, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/770,356

[22] Filed: Dec. 20, 1996

[30] Foreign Application Priority Data

Dec. 21, 1995 [JP] Japan ..... 7-349045

[51] Int. Cl.[6] ..... G10H 1/057

[52] U.S. Cl. ..... 84/627; 84/663

[58] Field of Search ..... 84/627, 663

[56] References Cited

U.S. PATENT DOCUMENTS 4,184,402 1/1980 Kugisawa ..... 84/627 X
4,373,416 2/1983 Endo et al. ..... 84/627 X
5,548,080 8/1996 Minamitaka et al. ..... 84/627

FOREIGN PATENT DOCUMENTS 236022 12/1994 Taiwan .

*Primary Examiner*—Stanley J. Witkowski
*Attorney, Agent, or Firm*—Graham & James LLP

[57] ABSTRACT

A musical tone waveform sample is generated at each sampling time by the use of a processing unit carrying out an arithmetic operation every repetition period that is longer than the sampling time. An envelope characteristic of a waveform of a musical tone to be generated is approximated by a polygonal line formed by a plurality of segments each of which has a length corresponding to the repetition period. An envelope value of a first waveform sample of waveform data of the musical tone to be generated for the repetition period is determined. The envelope value of the first waveform sample is multiplied by a predetermined attenuation factor to obtain an envelope value of a last waveform sample of the waveform data for the repetition period. Each of the segments of the polygonal line is determined by the envelope value of the first waveform sample and the envelope value of the last waveform sample. A difference between the envelope values of the first and last waveform samples is calculated. A decremental or incremental value per the each sampling time is obtained based on the difference. The envelope value of the waveform at the each sampling time is determined by adding the decremental or incremental value to an immediately preceding value of the envelope value of the waveform.

20 Claims, 11 Drawing Sheets

MUSICAL TONE-GENERATING METHOD AND APPARATUS CAPABLE OF APPROXIMATING ENVELOPE CHARACTERISTIC OF A WAVEFORM OF A MUSICAL TONE BY A POLYGONAL LINE

BACKGROUND OF THE INVENTION

1. Field of the Invention

This invention relates to a musical tone-generating method and a musical tone-generating apparatus for generating waveform samples of musical tones through arithmetic operations by the use of a programmable processing unit, such as a CPU (central processing unit) and a DSP (digital signal processor).

2. Prior Art

Conventionally, musical tones have been electronically generated by a tone generator incorporating a processing unit, such as a CPU (central processing unit) or a DSP (digital signal processor), which executes waveform-generating operations to generate waveform samples of musical tones, or by a general-purpose computer, such as a PC (personal computer), which executes a musical tone-generating program to generate musical tones without using special-purpose hardware.

To electronically generate musical tones, it is required to supply waveform samples generated by arithmetic operations to a DAC (digital-to-analog converter) whenever a sampling period elapses, i.e. in synchronism with digital-to-analog conversion timing of the DAC. This requires a very large amount of operation to be executed by the processing unit (hereinafter referred to as "the CPU"). In other words, to generate musical tones, the CPU has to execute processing for preparing musical tone control information and processing for generating waveform samples in response to performance information input thereto, such as MIDI event information.

For example, in the case of a tone generator employing a waveform memory method, the processing for generating waveform samples is executed in the following manner: Based on tone control information prepared from performance information, waveform-determining operations are executed for each tone generation channel by an LFO (Low Frequency Oscillator), a filter EG (envelope generator), a volume EG, etc. Waveform data is read from a waveform memory (waveform table) corresponding to the input performance information, while executing interpolation on the waveform data read from the waveform memory, if required. The resulting waveform data is multiplied by various kinds of EG waveform samples to thereby generate waveform sample data for a specific tone generation channel. These operations are repeatedly carried out for all the tone generation channels, and waveform sample data is accumulated for all the channels to thereby generate waveform data comprised of waveform samples each corresponding to a single sampling time period, i.e. the above-mentioned digital-to-analog conversion timing.

Now, a manner of calculating waveforms by the filter EG or the volume EG will be described with reference to FIGS. 1A to 1C. FIG. 1A shows an example of an envelope divided into four portions: an attack (A) portion, a decay (D) portion, a sustain (S) portion, and a release (R) portion. The level of each of the (A), (D), (S) and (R) portions is expressed by a logarithmic function,. and a musical tone generated based on the logarithmic function is recognized by the human ear as a linear level curve. In the figure, the ordinate represents frequency or amplitude, and the abscissa time. To calculate a value of the level of the envelope (hereinafter referred to as an or the "envelope value(s)") at each sampling time, the following method has been conventionally employed:

FIG. 1B shows an example of method of calculating envelope values on a logarithmic axis. According to this method, data of envelope are stored as logarithmic values, and as depicted in the figure, envelope values are calculated by sequentially adding an amount of change s per one sampling period, such that the calculated adjacent values have equal differences. The envelope values thus calculated and expressed in logarithm are converted to linear values by the use of a predetermined conversion table or by executing arithmetic operations on these values.

FIG. 1C shows another method of calculating envelope values, in which each envelope value obtained at the immediately preceding sampling time is sequentially multiplied by a rate of change $a^s$ per one sampling period to thereby calculate an envelope value at each sampling time. In this method, data of the envelope are not expressed in logarithmic values, but in normal values of amplitude or frequency.

As stated above, the amount of operation executed by the CPU for generating waveform samples of musical tones by arithmetic operations is very large. Further, the amount of operation dynamically varies depending upon the number of channels being used for sounding and the contents of tone-generating operations being executed.

Such a large processing load on the CPU causes the following inconveniences: It is impossible to increase the number of channels which can be used for tone generation. When a software tone generator program (hereinafter referred to as "software tone generator") is executed by a general-purpose computer in parallel with other application programs, the operations of these application programs can be made unstable due to a variation (particularly, an increase) in the amount of operation to be executed by the software tone generator.

Further, the FIG. 1B method calculating envelope values on the logarithmic axis uses addition, and therefore high-speed arithmetic operations can be achieved. However, it requires converting the results of the calculation to linear values, which makes it necessary to provide a conversion table or execute converting operations on the envelope values calculated. The FIG. 1C method uses multiplification which takes a longer time to execute. Although the use of a multiplier can shorten the time for the envelope value calculation, this requires additional provision of hardware, i.e. the multiplier.

SUMMARY OF THE INVENTION

It is an object of the invention to provide a musical tone-generating method and a musical tone-generating apparatus which are capable of reducing load on a CPU (central processing unit) in calculation of envelope waveforms of musical tones, to thereby decrease load on the CPU in executing waveform-generating operations to generate musical tones.

To attain the above object, according to a first aspect of the invention, there is provided a method of generating a musical tone waveform sample at each sampling time, by the use of a processing unit, the method comprising the steps of approximating an envelope characteristic of a waveform of a musical tone to be generated by a polygonal line formed by a plurality of segments, calculating an envelope value of the waveform at the each sampling time by the use of the polygonal line.

Preferably, each of the segments has a length equal to a repetition period of execution of an arithmetic operation for generating the musical tone waveform samples.

More preferably, the method includes the steps of reading waveform data of the musical tone to be generated for the repetition period, from a waveform table, determining an envelope value of a first waveform sample of the waveform data read from the waveform table, multiplying the envelope value of the first waveform sample by a predetermined attenuation factor to obtain an envelope value of a last waveform sample of the waveform data, and determining each of the segments of the polygonal line by the envelope value of the first waveform sample and the envelope value of the last waveform sample.

Further preferably, the method includes the steps of dividing a difference between the envelope value of the first waveform sample and the envelope value of the last waveform sample by a predetermined number of waveform samples to be obtained from the waveform data of the musical tone to be generated for the repetition period to obtain a decremental or incremental value per the each sampling time, and determining the envelope value of the waveform at the each sampling time by adding the decremental or incremental value to an immediately preceding value of the envelope value of the waveform.

Preferably, the approximating step comprises approximating an envelope characteristic of at least one of a sustain portion and a release portion of the musical tone to be generated, by the polygonal line formed by the plurality of segments.

More preferably, the waveform table stores waveform data of an attack portion and a decay portion data imparted with envelope characteristics, and waveform data of the sustain portion and the release portion without envelope characteristics.

According to a second aspect of the invention, there is provided a musical tone-generating apparatus including a processing unit for carrying out arithmetic operations on waveform data to generate a musical tone waveform sample at each sampling time, comprising an approximating device for approximating an envelope characteristic of a waveform of a musical tone to be generated by a polygonal line formed by a plurality of segments, and a calculating device for calculating an envelope value of the waveform at the each sampling time by the use of the polygonal line.

To attain the above objects, according to a third aspect of the invention, there is provided a machine readable storage medium-storing instructions to cause a machine to perform a method of generating a musical tone waveform sample at each sampling time, by the use of a processing unit, comprising the steps of approximating an envelope characteristic of a waveform of a musical tone to be generated by a polygonal line formed by a plurality of segments, and calculating an envelope value of the waveform at the each sampling time by the use of the polygonal line.

The above and other objects, features, and advantages of the invention will become more apparent from the following detailed description taken in conjunction with the accompanying drawings.

BRIEF DESCRIPTION OF THE DRAWINGS

FIGS. 4A to 4E are diagrams showing storage areas used in the embodiment, in which:

FIG. 4A shows an input buffer;

FIG. 4B shows a sample buffer;

FIG. 4C shows an output buffer;

FIG. 4D shows a tone color data register; and

FIG. 4E shows a tone generator register;

DETAILED DESCRIPTION

Next, the invention will now be described in detail with reference to the drawings showing a preferred embodiment thereof.

Figure 1A:
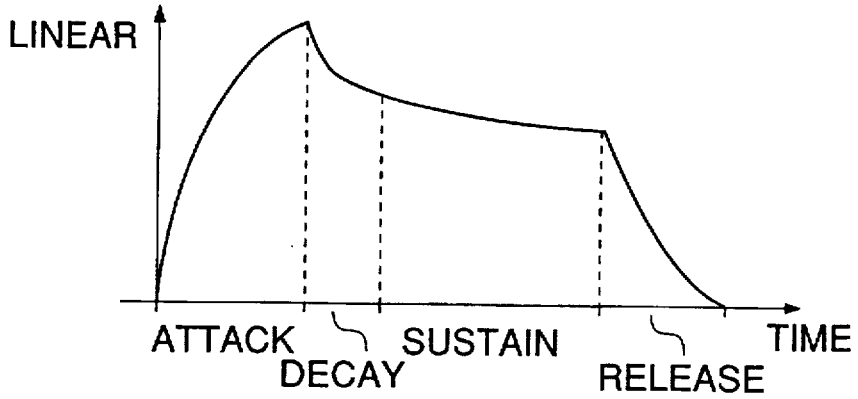
FIGS. 1A to 1C shows diagrams which are useful in explaining conventional methods of calculating envelope values.
Figure 1B:
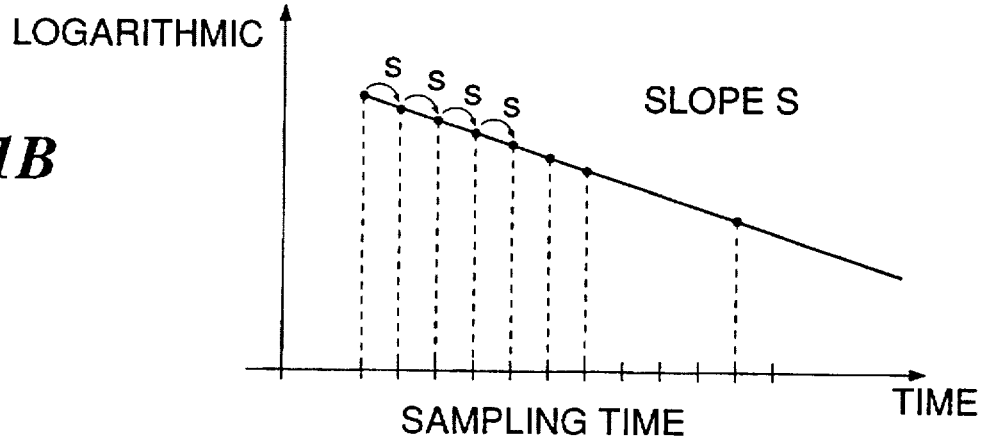
Figure 1C:
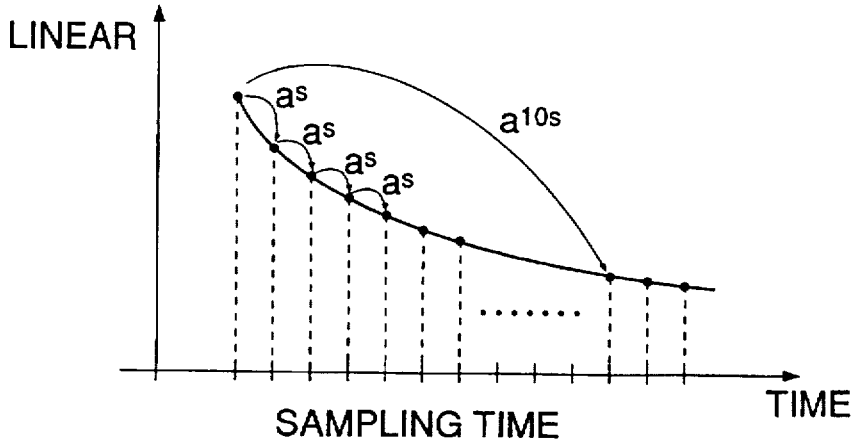
Figure 2:
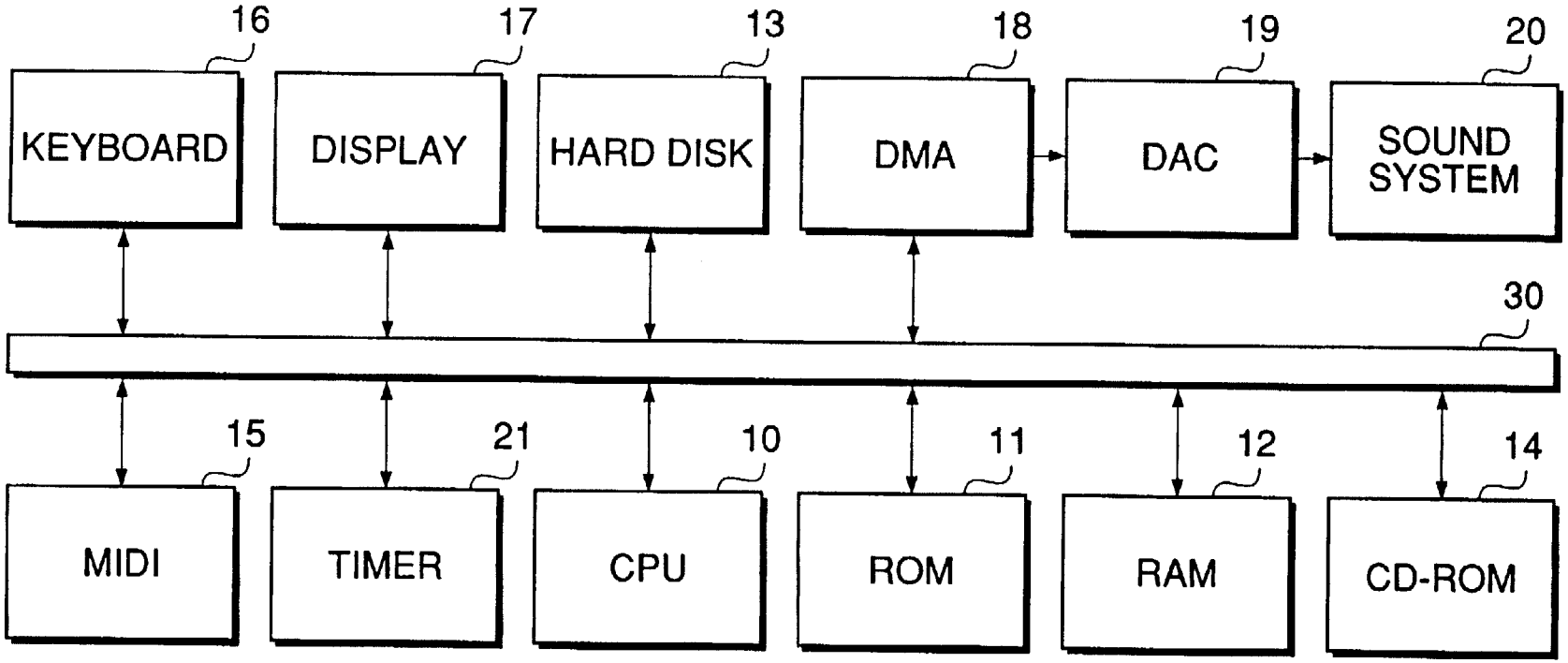
FIG. 2 is a block diagram schematically showing the whole arrangement of a musical tone-generating apparatus according to an embodiment of the invention.

Referring first to FIG. 2, there is shown a musical tone-generating apparatus according to an embodiment of the invention. In the figure, reference numeral 10 designates a central processing unit (CPU) which generates waveform samples of musical tones and executes various kinds of application programs, etc., 11 a read only memory (ROM) storing preset tone color data, etc., 12 a random access memory (RAM) for storing programs to be executed and data, as well as for providing work areas and various buffer areas, 13 a hard disk unit for storing various kinds of application programs, etc., and 14 a CD-ROM unit for driving CD-ROM's storing various kinds of data and programs, 15 a MIDI interface for transmitting and receiving performance data and control signals to and from a performance apparatus, such as a MIDI keyboard, which is externally connected to the present musical tone-generating apparatus. Reference numerals 16 and 17 designate a keyboard and a display unit, respectively, which are used as component parts of a general-purpose personal computer.

Reference numeral 18 designates a DMA (direct memory access) controller which reads waveform sample data directly from an output buffer area of the RAM 12, i.e. not through the CPU 10, 19 a DAC (digital-to-analog converter) for converting the waveform data from the DAM 18 to an analog tone signal, and 20 a sound system for amplifying the analog tone signal from the DAC 19 and sounding the resulting signal Reference numeral 21 designates a timer for generating an interrupt signal for interrupting the CPU 10 at predetermined time intervals and at the same time supplying sampling clocks to the DMA controller 18. These component parts 10 to 18 are connected to each other via a bus 30. The above described arrangement of the present musical tone-generating apparatus is identical with that of a general-purpose personal computer or work station. That is, the method according to the present invention can be implemented by a general-purpose personal computer or work station.

Figure 3:
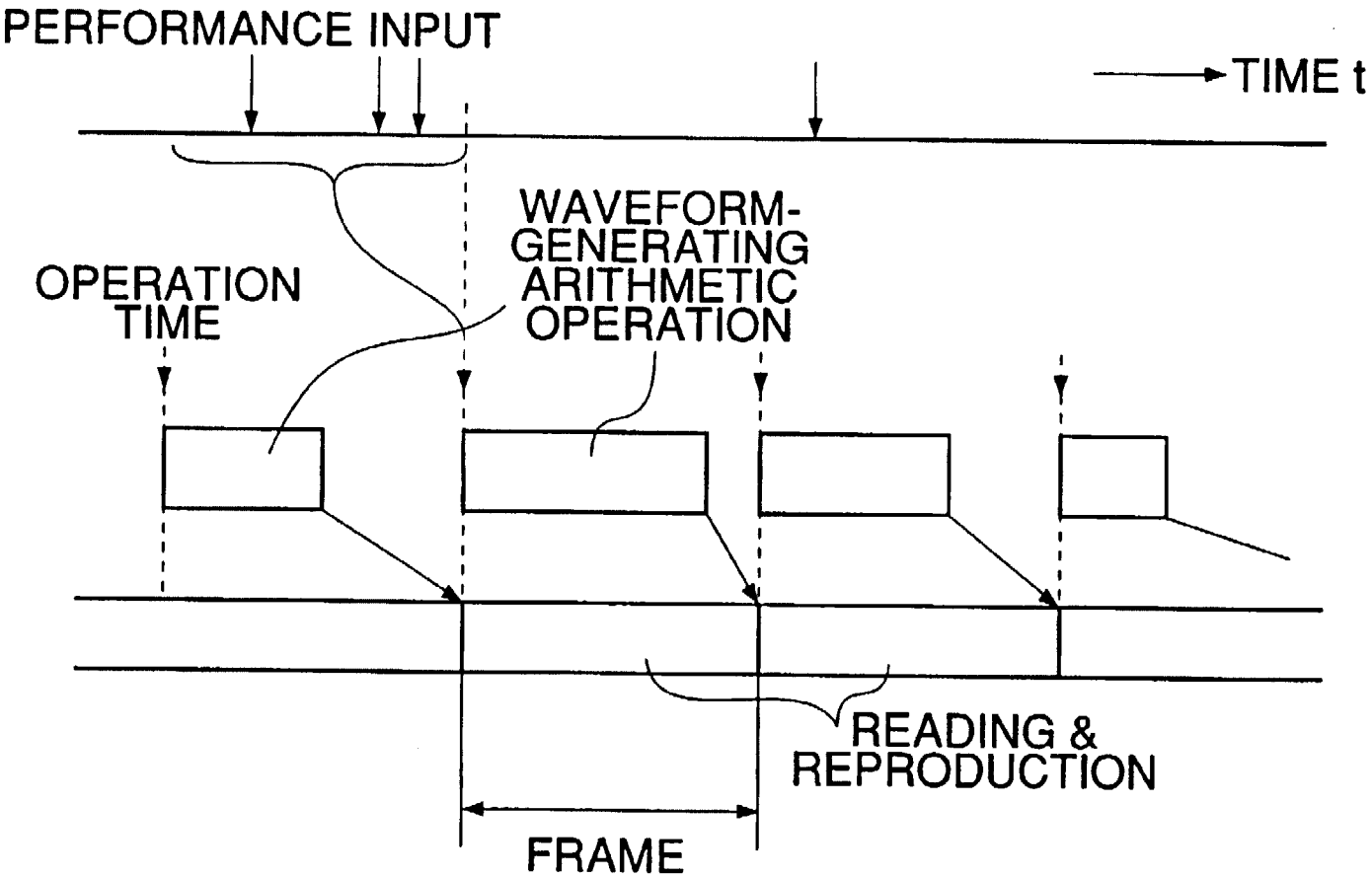
FIG. 3 is a diagram which is useful in explaining a flow of operations executed as time elapses by the embodiment.

FIG. 3 shows a flow of operations of a software tone generator implementing the present musical tone-generating method, which are executed by the musical tone-generating apparatus described above. The software tone generator normally generates waveform data of musical tones e.g. at a sampling frequency (rate) of 25.6 kHz. The waveform data-generating operation is executed every predetermined time period e.g. corresponding to 128 samples (1 frame). When performance data is input at a time slot corresponding to a frame, waveform data of a musical tone corresponding to the performance data input is calculated and generated by arithmetic operations in the immediately following frame, and then the waveform data of the musical tone thus generated is read out sample by sample every period of 25.6 kHz to form a musical tone signal in the next frame. That is, there is a time lag of about two frames between inputting of performance data and actual generation of musical tones (or attenuation of musical tones). However, since one frame is formed of 128 samples (which corresponds to about five milliseconds), the time lag is very small. The number of samples for one frame can be set as desired. However, as the number of samples is increased, there occurs an increasing delay of sounding, whereas as the number of samples is decreased, the margin of processing time decreases to degrade the responsiveness to an occasional increase in the amount of processing.

The present embodiment will be described on the assumption that a so-called table look-up method is employed which generates musical tones based on waveform samples stored in waveform tables provided in the RAM 12. Further, it is assumed that the software tone generator has 32 tone generation channels at the maximum.

Figure 4A:
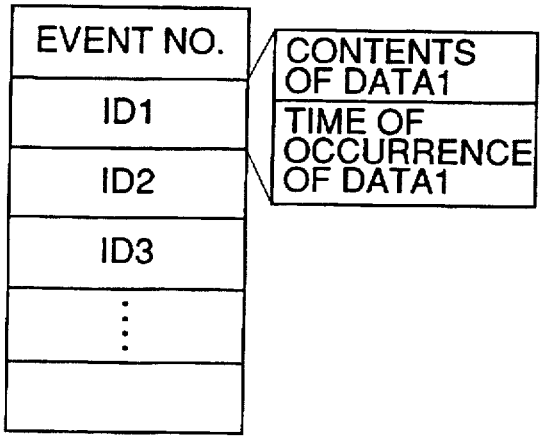

FIGS. 4A to 4E show storage areas of the RAM 12 allocated during operation of the software tone generator. FIG. 4A shows an input buffer for storing performance data input via the MIDI interface, together with data indicative of a time point of occurrence of the input event. The data or contents stored in this buffer are read out during MIDI processing, referred to hereinafter, to execute operations corresponding thereto.

Figure 4B:
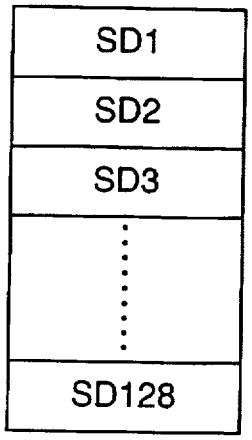
Figure 4C:
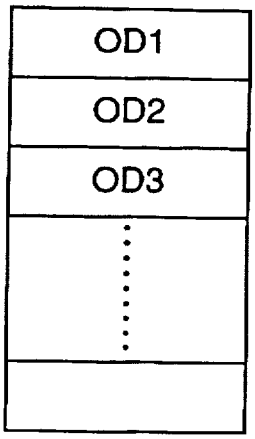

FIG. 4B shows a sample buffer WB, and FIG. 4C an output buffer OB. These buffers have an identical construction, that is, they are each provided with waveform data storage areas (SD1 to SD128, or OD1 to OD128) for storing 128 samples. The output buffer OB stores waveform data synthesized by sequentially adding up waveform data of musical tones for the 32 channels. The waveform data are generated by executing arithmetic operations on 128 samples of waveform data over a time period corresponding to one frame for each channel, and the same process is repeatedly carried out for all 32 channels at the maximum (i.e. for active channels). The sample buffer WB stores waveform data for one channel, and whenever waveform data for one i-th channel is obtained, the output buffer OB accumulates the thus obtained waveform data, i.e. in synchronism with the sampling timing.

Figure 4D:
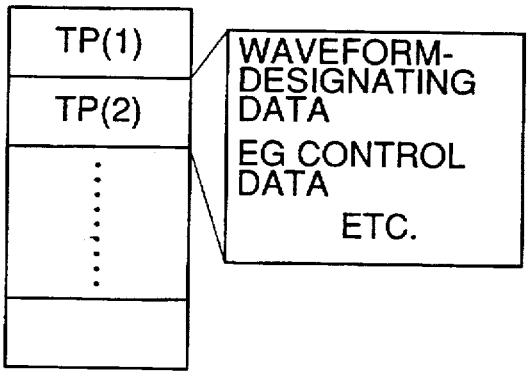

FIG. 4D shows a tone color register. The tone color register stores tone color data which determines a waveform of a musical tone generated by each MIDI channel (performance part). The tone color data includes waveform-designating data for designating a waveform table as material data for each range of an individual tone color, EG control data, etc.

Figure 4E:
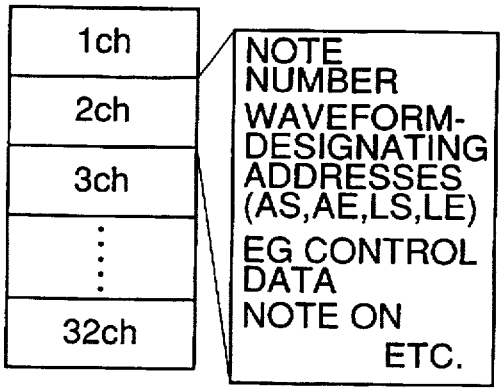

FIG. 4E shows a tone generator register. The tone generator register stores, separately for each tone generation channel, data for determining the waveform of a musical tone to be generated via the tone generation channel. The data stored in the tone generator register includes a note number, waveform-designating addresses (attack-start address AS, attack-end address AE, loop-start address LS, loop-end address LE) of a specific waveform table, filter control data, EG control data, note-on data, etc.

Next, the operation of the software tone generator using the present method will be described with reference to FIGS. 5A to 10.

Figure 5A:
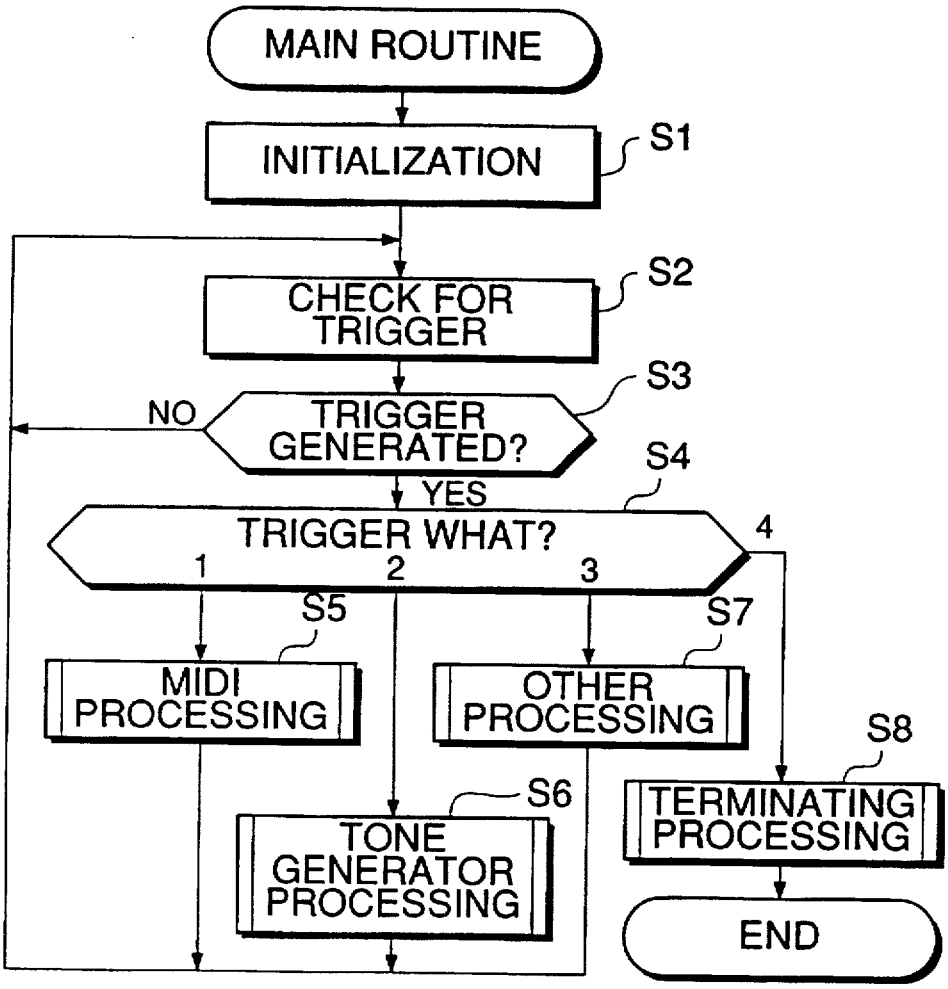
FIG. 5A is a flowchart showing a main routine executed by the embodiment.

FIG. 5A shows a main routine executed by the software tone generator. Upon starting of the tone generator program, initialization is executed, such as allocation of register areas, at a step S1, and then the CPU 10 is placed in a standby state at steps S2 and S3 until a trigger of any kind occurs. When a trigger has occurred, it is determined at a step S4 what kind of trigger has occurred. The trigger can be (1) writing of MIDI data into the input buffer, (2) generation of an interrupt signal by the timer 21 whenever a time period corresponding to one frame elapses, (3) occurrence of a switch event via a control panel, a window screen or the like, and (4) inputting of a termination command. According to the kind of trigger generated, one of MIDI processing (step S5), tone generator processing (step S6), other processing (step S7) and terminating processing (step S8) is executed.

By the terminating processing (step S8), settings of data are saved and the registers are cleared. Upon completion of this processing, the program is terminated. The other processing (step S7) is executed in response to various kinds of inputting via the control panel or command inputting. The tone generator processing (step S6) is executed in response to an interrupt generated by the timer 21 when it counts up and delivers 128 sample clocks or a trigger or the like generated by the DMA controller 18 for notifying that the reading of waveform data, described with reference to FIG. 3, proceeds to a next frame.

Figure 5B:
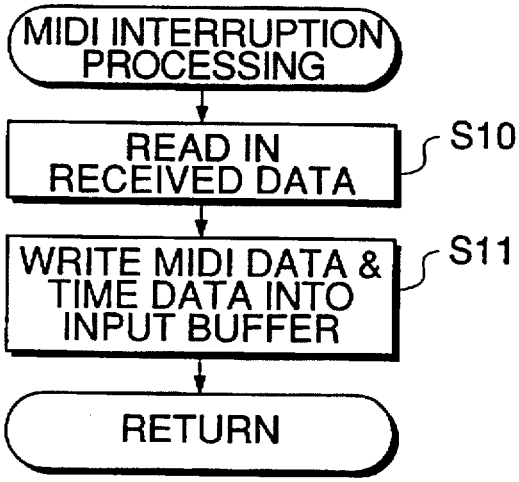
FIG. 5B is a flowchart showing a MIDI interrupt processing routine.

FIG. 5B shows a MIDI interrupt handling routine executed as a top-priority interrupt handling routine. The interrupt handling routine is started when MIDI data is received from the MIDI interface 15. The MIDI data is fetched at a step S10, and the received MIDI data and data indicative of the receiving time point are written into the input buffer appearing in FIG. 4A at a step S11.

The MIDI processing (step S5) is started when the MIDI data is written into the input buffer, and operations corresponding to the written MIDI data are executed.

Figure 6:
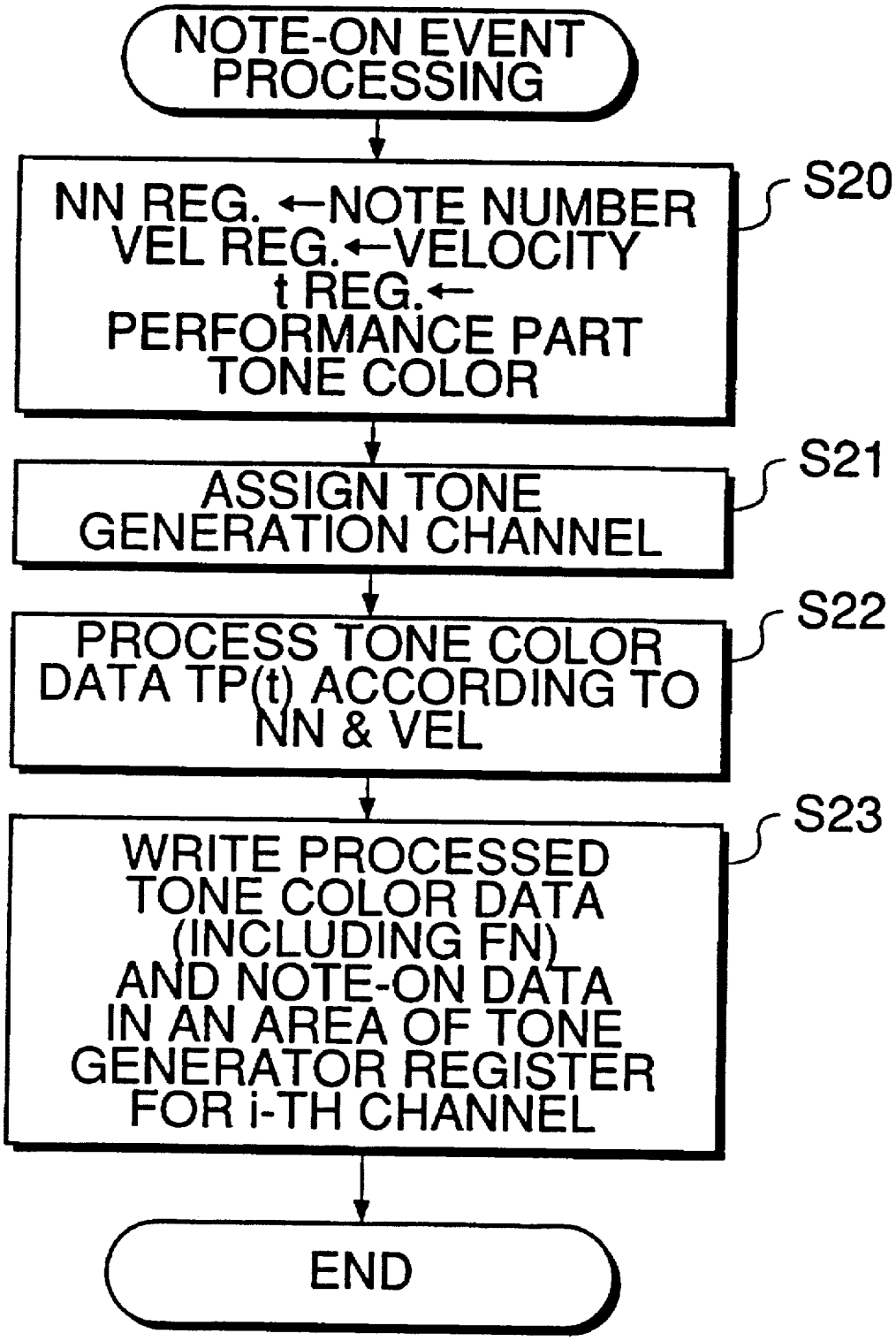
FIG. 6 is a flowchart showing a note-on event processing routine.

FIG. 6 shows a note-on event processing routine as one of routines for executing the MIDI processing. The note-on event processing routine is executed when note-on event data is written into the input buffer. First, a note number, velocity data, and a part-specific tone color of the note-on event data are stored in an NN register, a VEL register and a t register, none of which is shown, respectively, at a step S20. Then, a tone generation channel for a musical tone to be generated by the note-on event is assigned to one of the 32 tone generation channels and data indicative of the assigned tone generation channel (i-th channel) is stored in an i-th register at a step S21. The tone color data TP(t) to be generated by the note-on event is processed according to the note number NN and the velocity data VEL at a step S22. Then, a processed tone color data (including F number (FN)) data indicative of the note-on event as well as timing information TM are written into an area of the tone generator register for the i-th channel designated by the data stored in the i register at a step S23.

Figure 7:
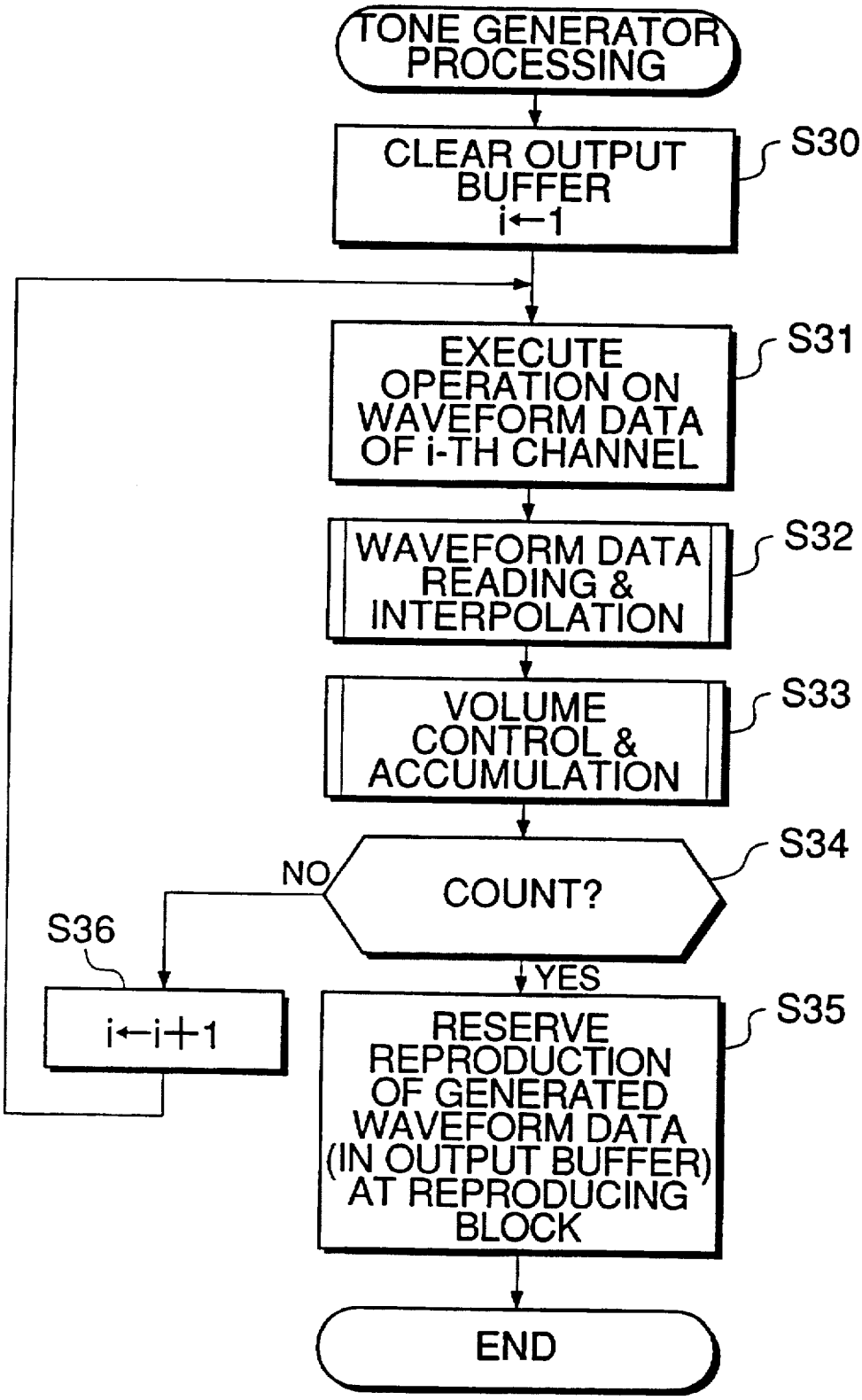
FIG. 7 is a flowchart showing a tone generator processing routine.

FIG. 7 shows a routine for carrying out the tone generator processing executed at the step S6 in FIG. 5A at a repetition period corresponding to one frame. First, the output buffer OB is cleared, and at the same time a pointer i for indicating the order of arithmetic operations to be carried out is set to "1" at a step S30. Then, preparation processing is carried out at a step S31 to prepare for arithmetic operations on waveform data, e.g. by setting addresses for the i-th channel of the tone generator register to thereby enable data of the i-th channel to be read out from a designated waveform table. Then, reading of waveform data from the designated waveform table and interpolation of waveform data read out from the designated waveform table are executed at a step S32. Details of the processing of waveform data reading and interpolation will be described with reference to FIG. 8. When this processing (step S32) has been completed, the program proceeds to a step S33, wherein volume control and data accumulation are carried out. The processing of volume control and data accumulation will be described with reference to FIGS. 9 and 10.

Then, it is determined at a step S34 whether or not arithmetic operations on waveform data of all the tone generation channels have been completed. If the arithmetic operations have not been completed, the pointer i is incremented to "i+1" at a step S36, and the preparation processing for arithmetic operations on waveform data of the next channel i is executed at the step S31, followed by executing the following steps S32 and S33. When the arithmetic operations on the waveform data of all the channels have been completed, reproduction of waveform data generated in the output buffer OB is reserved at the DMA controller 18 at a step S35. The reservation for reproduction is executed by notifying the DMA controller 18 of memory addresses within the RAM 12.

Figure 8:
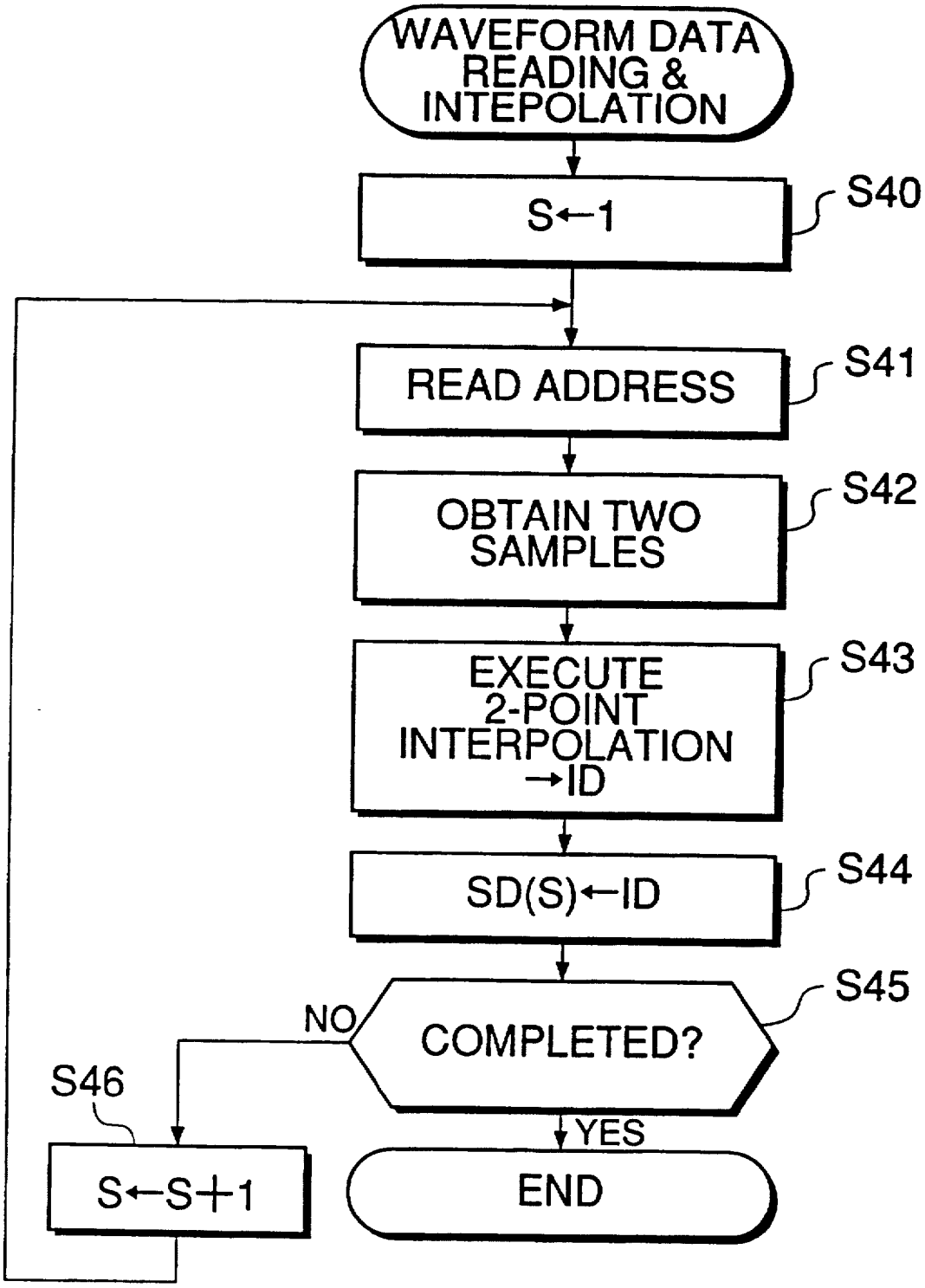
FIG. 8 is a flowchart showing a waveform data-reading/interpolating processing routine.

Now, the processing of waveform data reading and interpolation (at step S32 in FIG. 7) will be described with reference to FIG. 8. This routine is executed to generate waveform data for a channel designated by the pointer i by collectively processing one frame (128 samples) of data. First, a sample number s counter is set to "1" at a step S40. Then, the F number is added to the immediately preceding reading address used in the arithmetic operation on waveform data (the last address generated for reading waveform data of the immediately preceding frame for the present tone generation channel) to update the reading address at a step S41. Normally, a reading address having an integer part and a decimal part is generated, so that waveform data of two samples (a sample designated by the integer part and a sample designated by the integer part+1) are read from the designated waveform table at a step S42. The data of two samples are subjected to linear interpolation by the use of the value of the decimal part, and the resulting value is set into an ID register at a step S43. Then, the contents of the ID register are set into the sample buffer SD(s) at a step S44. This operation is repeatedly carried out from s="1" to s="128", at steps S45 and S46, and upon completion of 128 times repetition of the operation, the program returns to the tone generator processing (FIG. 7).

Figure 9:
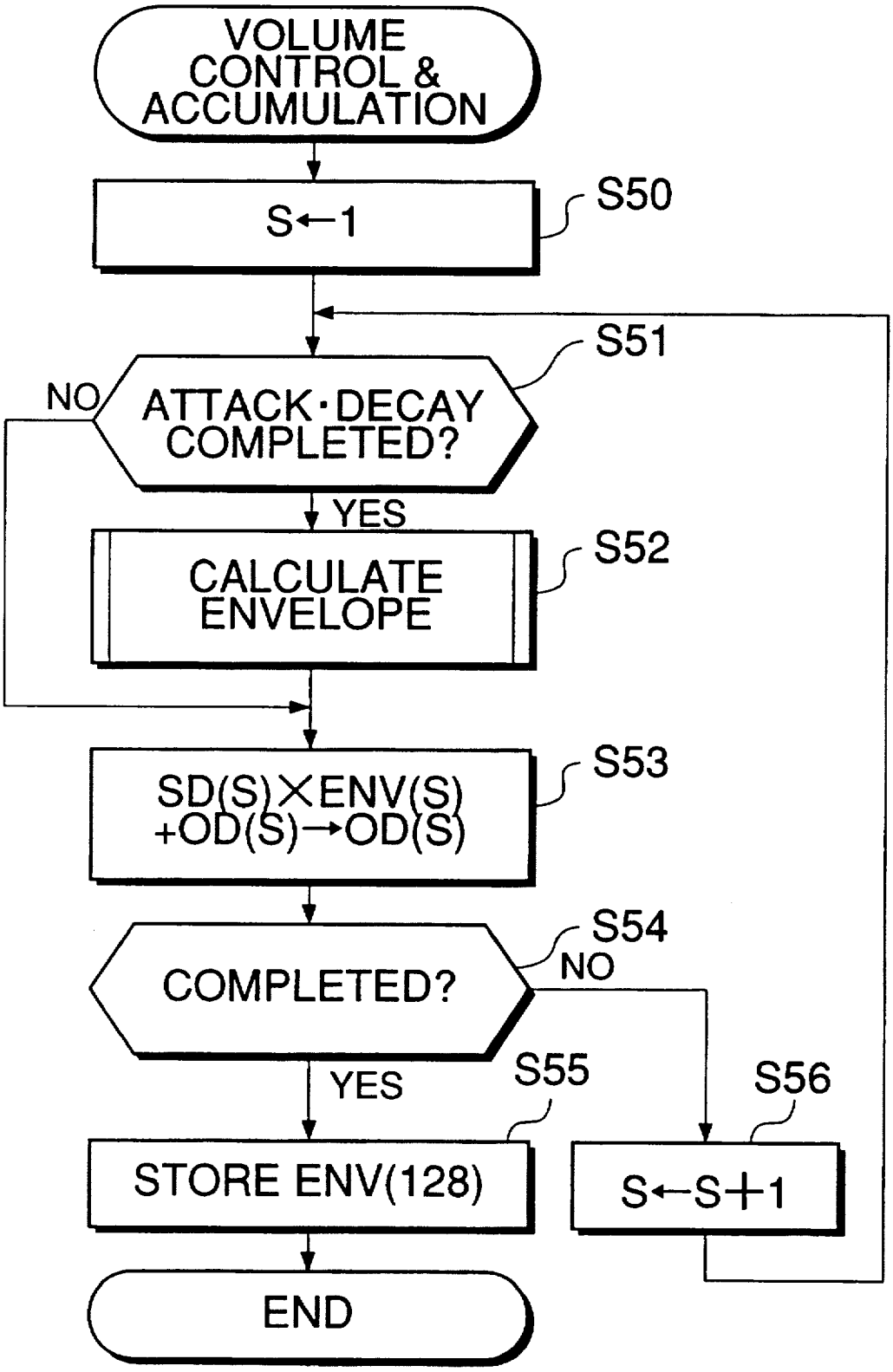
FIG. 9 is a flowchart showing a volume control/data accumulation processing routine.

Next, the processing of volume control and data accumulation at the step S33 in FIG. 7 will be described with reference to FIG. 9. This processing imparts to values read from the sample buffer WB (SD(1) to SD(128)) time-dependent variations in volume which should occur from a rise or attack of a musical tone generated to a release of the same, based on the amplitude EG and channel volume control parameters.

As stated hereinabove, in the present embodiment, the sampling frequency is set to 25.6 kHz, and one frame is set to 128 samples. Accordingly, the repetition period of arithmetic operation on waveform data is equal to 128×(1/25.6 (kHz))=5 (milliseconds). Further, for the sake of simplicity of description, let it be assumed that the attack portion and the decay portion of the envelope are set to an integral multiple of five milliseconds (=time for 128 samples).

Figure 11A:
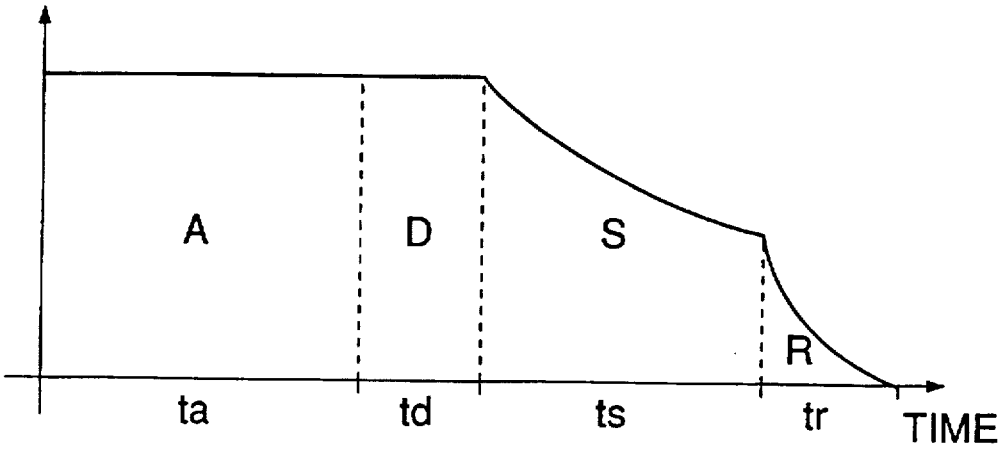
FIGS. 11A and 11B are diagrams which are useful in explaining a method of calculating envelope values according to the embodiment.

FIG. 11A shows an example of EG control data used in the processing of volume control and data accumulation executed at the step S32 in FIG. 7. In the present embodiment, waveform data of each musical tone stored in the waveform table contains data of an attack (A) portion and a decay (D) portion imparted with envelope characteristics. Therefore, it is neither required to form envelope data for the attack (A) portion and the decay (D) portion nor to multiply calculated waveform data of these portions by the envelope data. Therefore, the EG control data for the attack (A) portion and the decay (D) portion only contains time information data ta and td indicative of durations of these portions (attack time and decay time). On the other hand, EG control data for a sustain (S) portion and a release (R) portion of each musical tone stored in the waveform table contains not only time information data ts, tr indicative of durations of these portions (sustain time and release time), but also attenuation factors S' and R', i.e. rates of attenuation of these portions of the musical tone to be generated per one frame time.

When the processing of volume control and data accumulation (step S33 in FIG. 7) is started, first the sample number s counter is set to "1" at a step S50. Then, it is determined at a step S51 whether or not reproduction or sounding of the attack (A) portion and the decay (D) portion of the musical tone has been completed. This determination is carried out by referring to data of the attack time ta and the decay time td. If it is determined that the attack (A) portion or the decay (D) portion is being sounded, the program proceeds to a step S53. As stated above, as for the attack (A) portion and the decay (D) portion, waveform data imparted with envelope characteristics are stored in the waveform memory (waveform table), so that an envelope value ENV(s) is assumed to be equal to "1" and the contents of the sample buffer SD(s) are directly added to the output buffer OD(s).

On the other hand, if it is determined that reproduction of the attack (A) portion and the decay (D) portion has been completed, which means that the sustain (S) portion or the release (R) portion is being sounded, calculation of an envelope value is carried out at a step S52 to thereby obtain the envelope value ENV(s) for the present sampling time. Details of this processing will be described hereinafter. From the step S52, the program proceeds to a step S53, wherein the contents of the sample buffer SD(s) are multiplied by the envelope value ENV(s) calculated at the step S52, and the resulting product is added to the output buffer OD(s). This operation is repeatedly carried out from s="1" to s="128", at steps S54 and S56, and upon completion of 128 times repetition of the operation, the envelope value (ENV(128)) calculated for the 128-th sample is stored for calculation in the next frame, followed by the program returning to the tone generator processing (FIG. 7).

Now, the processing of calculating the envelope value executed at the step S52 in FIG. 9, which forms an essential feature of the invention, will be described with reference to FIGS. 10 and 11B. According to this processing, the envelope is approximated by segments forming together a polygonal line and each corresponding to one frame time (in the present embodiment, 128 samples×(1/25.6 kHz)=5 milliseconds) to thereby obtain an envelope value at each sampling time. That is, as shown in FIG. 11B, (1) first, an initial value is set to I, and an envelope value at the 128-th sample is calculated as a value of I×S' (or I×R'); (2) the difference between the 128-th sample envelope value I×S' (or I×R') and the initial value I is divided by 128 to obtain a decremental or incremental value Δ per one sampling period; and (3) the decremental or incremental value Δ is added to the initial value I for each sampling period to obtain an envelope value ENV(s) corresponding to the present sampling time. In this manner, the envelope value is calculated.

It should be noted that so long as each segment of a polygonal line approximating a curve of an envelope of a musical tone has a length corresponding to a duration of several or several tens milliseconds, practically the human ear can hardly discern discontinuities of the curve between adjacent segments.

Figure 10:
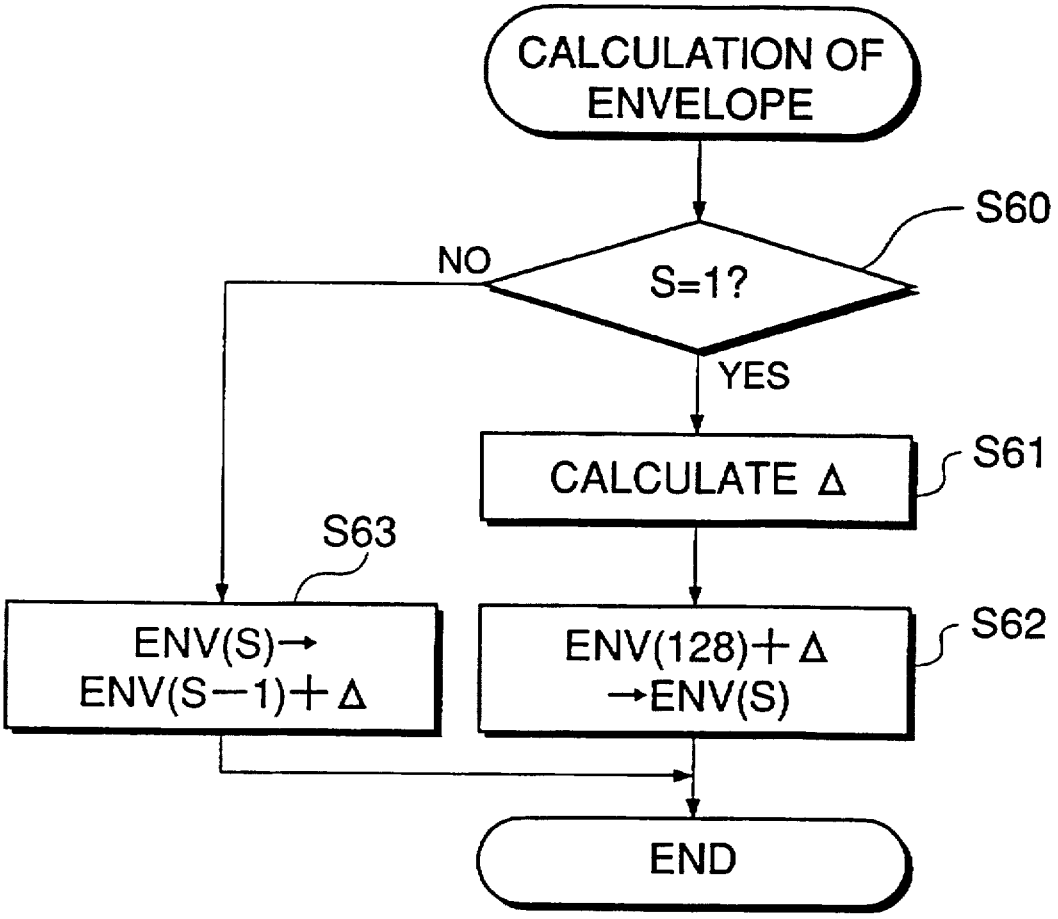
FIG. 10 is a flowchart showing an envelope-calculating processing routine.
Figure 11B:
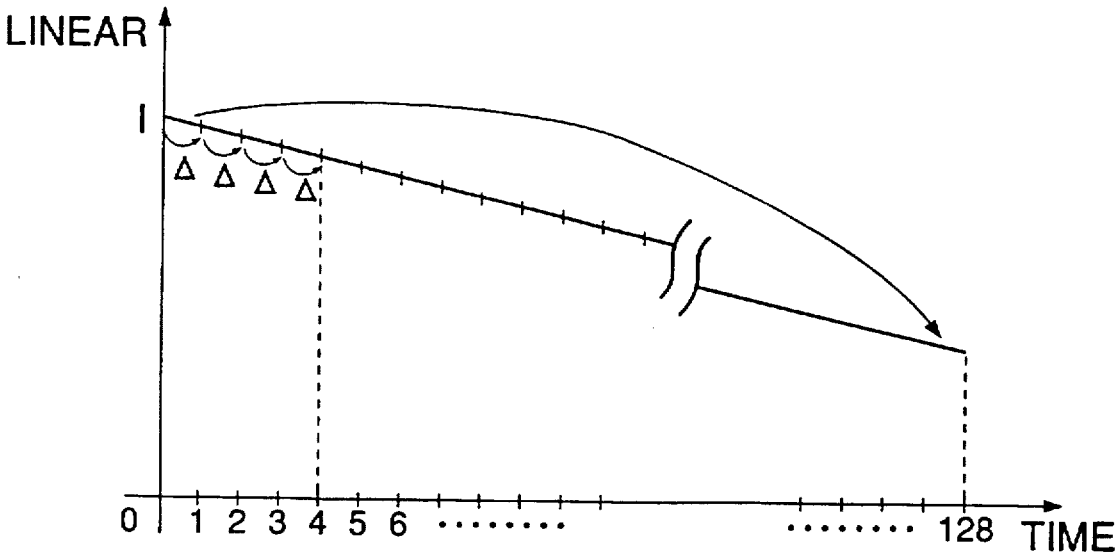

Referring to a routine for calculating the envelope value, shown in FIG. 10, first, it is determined at a step S60 whether or not the count s is equal to 1. If s=1 holds, which means that the present waveform sample is the first sample within one frame period, the program proceeds to a step S61, wherein calculation of the decremental and incremental value Δ per one sampling period is carried out. This value is obtained, as mentioned above, by the use of an equation Δ=(I×S'−I)/128 or Δ=(I×R'−I)/128. Then, the decremental and incremental value Δ calculated is added to the last envelope value ENV(128) obtained in the immediately preceding frame, and the resulting sum is set to an envelope value ENV(s) (in the present case, ENV(1)) at a step S62, followed by the program returning to the processing of volume control/data accumulation.

If s=1 does not hold at the step S60, the decremental and incremental value Δ calculated is added to the value envelope ENV(s-1) obtained at the immediately preceding sampling time to calculate the present envelope value ENV(s), followed by the program returning to the processing of volume control and data accumulation.

By calculating the envelope values for the sustain (S) portion and the release (R) portion in the above described manner, the envelope value for each musical tone can be obtained merely by executing an multiplying operation which requires a long time (e.g. corresponding to ten system clocks) only two times for the sustain (S) portion and the release (R) portion, and an addition operation which requires a short time (e.g. corresponding to two system clocks) at the remaining sampling times.

Further, although in the present embodiment, the envelope is approximated by a polygonal line formed of segments each corresponding to one frame time, this is not limitative, but the polygonal line is only required to be formed of segments each having a length corresponding to several or several tens milliseconds.

Further, although in the above described embodiment, as for the attack (A) portion and the decay (D) portion, waveform data imparted with envelope characteristics are stored in the waveform table, this is not limitative, but waveform data of the attack (A) portion and the decay (D) portion may be stored in a similar form to waveform data of the sustain portion and the release portion in the present embodiment, for which the processing of envelope value calculation essential to the invention is executed.

What is claimed is:

1. A method of generating a musical tone waveform sample at each sampling time, by the use of a processing unit carrying out an arithmetic operation every repetition period that is longer than said sampling time, by determining an envelope value of said waveform sample at said each sampling time through an approximation of an envelope characteristic of a waveform of a musical tone to be generated by a polygonal line formed by a plurality of segments, each of which has a length corresponding to said repetition period, comprising the steps of:

determining an envelope value of a first waveform sample of waveform data of said musical tone to be generated for said repetition period;

multiplying said envelope value of said first waveform sample by a predetermined attenuation factor to obtain an envelope value of a last waveform sample of said waveform data for said repetition period;

calculating a difference between said envelope value of said first waveform sample and said envelope value of said last waveform sample, said difference corresponding to each of said segments of said polygonal line;

obtaining a decremental or incremental value per said each sampling time, based on said difference; and determining said envelope value of said waveform sample at said each sampling time by adding said decremental or incremental value to an envelope value of an immediately preceding waveform sample.

2. A method according to claim 1, wherein said approximation comprises approximating an envelope characteristic of at least one of a sustain portion and a release portion of said musical tone to be generated, by said polygonal line formed by said plurality of segments.

3. A method according to claim 2, including the step of reading waveform data of said musical tone to be generated for said repetition period from a waveform table, said waveform table storing waveform data of an attack portion and a decay portion data imparted with envelope characteristics, and waveform data of said sustain portion and said release portion without envelope characteristics.

4. A musical tone-generating apparatus including a processing unit for carrying out arithmetic operations on waveform data every repetition period that is longer than sampling time to generate a musical tone waveform sample at said each sampling time by determining an envelope value of said waveform sample at said each sampling time, comprising an approximating device for approximating an envelope characteristic of waveform of a musical tone to be generated by a polygonal line formed by a plurality of segments, each of said plurality of segments having a length corresponding to said repetition period, said approximating device comprising:

a first determining device for determining an envelope value of a first waveform sample of waveform data of said musical tone to be generated for said repetition period;

a multiplying device for multiplying said envelope value of said first waveform sample by a predetermined attenuation factor to obtain an envelope value of a last waveform sample of said waveform data for said repetition period;

a calculating device for calculating a difference between said envelope value of said first waveform sample and said envelope value of said last waveform sample, said difference corresponding to each of said segments of said polygonal line;

an obtaining device for obtaining a decremental or incremental value per said each sampling time, based on said difference; and a second determining device for determining said envelope value of said waveform sample at said each sampling time by adding said decremental or incremental value to an envelope value of an immediately preceding waveform sample.

5. A machine readable storage medium-storing instructions to cause a machine to perform a method of generating a musical tons waveform sample at each sampling time, by the use of a processing unit carrying out an arithmetic operation every repetition period that is longer than said sampling time, by determining an envelope value of said waveform sample at said each sampling time through an approximation of an envelope characteristic of a waveform of a musical tone to be generated by a polygonal line formed by a plurality of segments each of which has a length corresponding to said repetition period comprising the steps of:

determining an envelope value of a first waveform sample of waveform data of said musical tone to be generated for said repetition period;

multiplying said envelope value of said first waveform sample by a predetermined attenuation factor to obtain an envelope value of a last waveform sample of said waveform data for said repetition period;

calculating a difference between said envelope value of said first waveform sample and said envelope value of said last waveform sample, said difference corresponding to each of said segments of said polygonal line;

obtaining a decremental or incremental value per said each sampling time, based on said difference; and determining said envelope value of said waveform sample at said each sampling time by adding said decremental or incremental value to an envelope value of an immediately preceding waveform sample.

6. A method of generating a musical tone waveform sample at each sampling time, by the use of a processing unit carrying out an arithmetic operation every repetition period that is longer than said sampling time, comprising the steps of:

preparing an initial envelope value for musical tone waveform samples to be generated for said repetition period;

multiplying said initial envelope value by a predetermined factor to obtain a last envelope value for said musical tone waveform samples to be generated for said repetition period;

obtaining a decremental or incremental value per said each sampling time, based on said initial envelope value and said last envelope value; and determining an envelope value corresponding to each of said musical tone waveform samples to be generated for said repetition period by adding said decremental or incremental value to an envelope value of an immediately preceding musical tone waveform sample.

7. A method according to claim 6, further comprising the steps of:

reading a waveform sample to be generated at said each sampling time from a waveform table; and multiplying said waveform sample by said corresponding envelope value to obtain said musical tone waveform sample to be generated at said each sampling time.

8. A method according to claim 7, further comprising the steps of:

writing a plurality of said musical tone waveform samples into a buffer; and reading said plurality of musical tone waveform samples from said buffer one by one at said each sampling time.

9. A method according to claim 6, further comprising the step of:

adopting an envelope value of a last one of musical tone waveform samples generated for an immediately preceding one of said repetition period as said initial envelope value.

10. A method according to claim 6, further comprising the step of:

adopting an envelope value of a first one of said musical tone waveform samples to be generated for said repetition period as said initial envelope value.

11. A method according to claim 6, wherein said musical tone waveform samples are waveform samples of a sustain portion of a musical tone to be generated.

12. A method according to claim 6, wherein said musical tone waveform samples are waveform samples of a release portion of a musical tone to be generated.

13. A musical tone-generating apparatus including a processing unit for carrying out arithmetic operations every repetition period that is longer than said sampling time to generate a musical tone waveform sample at said each sampling time, comprising:

a preparing device for preparing an initial envelope value for musical tone waveform samples to be generated for said repetition period;

a multiplying device for multiplying said initial envelope value by a predetermined attenuation factor to obtain a last envelope value for said musical tone waveform samples to be generated for said repetition period;

an obtaining device for obtaining a decremental or incremental value per said each sampling time, based on said initial envelope value and said last envelope value; and a determining device for determining an envelope value corresponding to each of said musical tone waveform samples to be generated for said repetition period by adding said decremental or incremental value to an envelope value of an immediately preceding musical tone waveform sample.

14. A musical tone-generating apparatus according to claim 13, further comprising:

a reading device for reading a waveform sample to be generated at said each sampling time from a waveform table; and a multiplying device for multiplying said waveform sample by said corresponding envelope value to obtain said musical tone waveform sample to be generated at said each sampling time.

15. A musical tone-generating apparatus according to claim 13, further comprising:

a writing device for writing a plurality of said musical tone waveform samples into a buffer; and a reading device for reading said plurality of musical tone waveform samples from said buffer one by one at said each sampling time.

16. A musical tone-generating apparatus according to claim 13, further comprising:

an adopting device for adopting an envelope value of a last one of musical tone waveform samples generated for an immediately preceding one of said repetition period as said initial envelope value.

17. A musical tone-generating apparatus according to claim 13, further comprising:

an adopting device for adopting an envelope value of a first one of said musical tone waveform samples to be generated for said repetition period as said initial envelope value.

18. A musical tone-generating apparatus according to claim 13, wherein said musical tone waveform samples are waveform samples of a sustain portion of a musical tone to be generated.

19. A musical tone-generating apparatus according to claim 13, wherein said musical tone waveform samples are waveform samples of a release portion of a musical tone to be generated.

20. A machine readable storage medium-storing instructions to cause a machine to perform a method of generating a musical tone waveform sample at each sampling time, by the use of a processing unit carrying out an arithmetic operation every repetition period that is longer than said sampling time, the method comprising the steps of:

preparing an initial envelope value for musical tone waveform samples to be generated for said repetition period;

multiplying said initial envelope value by a predetermined factor to obtain a last envelope value for said musical tone waveform samples to be generated for said repetition period;

obtaining a decremental or incremental value per said each sampling time, based on said initial envelope value and said last envelope value; and determining an envelope value corresponding to each of said musical tone waveform samples to be generated for said repetition period by adding said decremental or incremental value to an envelope value of an immediately preceding musical tone waveform sample.

* * * * *